United States Patent [19]

Fukuoka

[11] 4,079,526

[45] Mar. 21, 1978

[54] FOOTWEAR

[76] Inventor: Tatsuo Fukuoka, 3-3, 2-chome, Shinminamifukushima, Tokushima, Japan

[21] Appl. No.: 750,199

[22] Filed: Dec. 13, 1976

[30] Foreign Application Priority Data

Dec. 27, 1975 Japan ..... 50-179263

[51] Int. Cl.[2] ..... A43B 13/12; A43B 3/12; A43B 13/38

[52] U.S. Cl. ..... 36/30 R; 36/11.5; 36/44

[58] Field of Search ..... 36/1, 11.5, 43, 44, 36/30 R; 128/25 B, 581, 582, 614, 615

[56] References Cited

U.S. PATENT DOCUMENTS

| | | | |
|---|---|---|---|
| 2,852,865 | 9/1958 | Spalding | 36/43 |
| 3,059,350 | 10/1962 | Price | 36/11.5 |
| 3,722,113 | 3/1973 | Birkenstock | 36/43 |
| 3,859,727 | 1/1975 | Nakamoto | 36/44 |
| 4,015,347 | 4/1977 | Morishita et al. | 36/44 |

FOREIGN PATENT DOCUMENTS

| | | | |
|---|---|---|---|
| 472,217 | 9/1937 | United Kingdom | 128/615 |

*Primary Examiner*—Patrick D. Lawson
*Attorney, Agent, or Firm*—Browdy and Neimark

[57] ABSTRACT

A footwear includes a bottom body formed from soft synthetic resin and a hard or semihard core material laid on the bottom body. The bottom body has a pressure projection protruding upwards from the upper face of the core material and there is provided a fitting construction for the core material of the peripheral edge of the pressure projection, whereby the core material is secured to the bottom body at the fitting construction. The pressure projection of this footwear provides a comfortable wearing feeling and strongly locks the core material laid on the bottom body, preventing disengagement thereof from the bottom body.

8 Claims, 8 Drawing Figures

FOOTWEAR

FIELD OF THE INVENTION

The present invention relates to footwear providing a comfortable wearing feeling and more particularly to footwear which can press and stimulate vital points of the feet thereby resulting in a comfortable wearing feeling.

BACKGROUND OF THE INVENTION

"Vital point", referred to herein is called "Tsubo" in Japanese and means vital point for oriental therapy.

In general, the oriental medical science has actually proved that an abnormal state of the body can be regulated to a normal state by giving some stimulation to the vital points. A means for giving stimulation to a vital point which is most generally carried out is to press the vital point by the thumb or other four fingers or by the whole of the palm of the hand. When the vital point is finger pressed, the flow of the "Keiraku", as it is referred to in the oriental medical science, becomes good, so that various diseases can be treated, and this is the basic principle of the oriental medical science. The Keiraku means the circulatory system which gives energy to Rokuzo Rokufu (main viscera) during the circulation therethrough, Rokuzo Rokufu being such that play an important part for the life of the human being. Rokuzo means the liver, the heart, the spleen, the lungs, the kidney and shinpo, and Rokufu means the gall bladder, the small intestines, the stomach, the colon, the bladder and sansho. The body of the human is controlled by these Rokuzo and Rokufu, and when a trouble occurs in these viscera, the condition of the body may get out of order.

The vital points of the foot exist at positions fairly far away from the viscera, but it has been proved by the oriental medical science that stimulation to the vital points is very effective for the viscera, such as stomach and so on, and from the principle of the modern circulatory physiology, the blood circulation of the fingers and toes, namely, the peripheral circulatory dynamic condition is very delicate, and if the blood circulation of these parts is normal, the hands and feet are warm, and when the vital points are stimulated, the blood circulation of all the body, particularly the breast and abdomen are regulated, thereby resulting in removing of various conditions of diseases, and this has been proved by experiments carried out for many years.

With regard to the vital points distributed on the foot, the positions of the vital points distributed on the sole of the foot of Ingamn-si-observation are shown in FIG. 1. In FIG. 1, the vital point 1 relates to the eye, and 2 to the lungs and the bronchial tubes, and the Yusen of the vital point 3 to the suprarenal body, and the vital point 4 to the heart, and 5 to the kidney, the heart and blood pressure, 6 to the suprarenal body, 7 to the waist and sexual organs, 8 to the colon, 9 to the spinal cord reflex part, and 10 to the kidney respectively, and when these vital points are subject to pressure stimulation, there may have effect on the respective parts. For example, if the Yusen part of the vital point 3 is subject to pressure stimulation, a medical treatment to the related part may be expected.

The present invention relates to footwear having a pressure projection.

In general, it is required for the bottom of shoes, sandals etc., that the heel portion is hard but the forward portion has flexibility which allows bending with the foot upon walking. Accordingly, in the case of prior art shoes, an iron plate is fitted in the rear portion of the bottom by means of nail stoppers, etc. Also, in the case of sandals the bottom of which is integrally molded, as shown in FIG. 2, it was necessary that a hard core material 11 be inserted in the heel portion. However, when the bottom of such kind is produced, the core material 11 must be temporarily stopped at a given position of the metal mold previously, and due to such a working the productivity of such bottom was greatly reduced.

Such a drawback is quite identical for footwear having pressure projections, and also in the case of production of bottoms having pressure projection provided by integral molding. It is necessary that the core materials 11 are inserted one by one before molding, resulting in greatly reducing the productivity of such bottoms.

In an attempt to remove the above drawbacks, the present inventor tried to produce a bottom of such a construction that, as shown in FIG. 3, a hard or semihard core material 13 was laid on the bottom body 12 and projections 14 were provided on the back face of the core material 13, and these projections 14 were inserted in holes formed in the bottom body 12. However, this construction had such drawbacks that the projections are made larger than the holes of the bottom body, namely they are tightly inserted in the holes in order to make difficult for the core material 13 to slip out, or when the projections are made larger or the forward ends of the projections are made larger, they become difficult to be inserted in the bottom. This method has the further drawback that it is necessary to prevent the slipping-out of the core material solely by the cooperation of the projections and the holes resulting from the mere pushing-in of the projection of the back face of the core material into the holes of the bottom body.

SUMMARY OF THE INVENTION

The present inventor has studied how to solve such drawbacks and increase the productivity of the productions of bottoms having a pressure projection, and as a result has solved them in such a manner that a bottom body of a soft synthetic resin and a semihard core material are molded separately and thereafter the core material is locked to the bottom body by means of a pressure projection protruding from the bottom body.

The present invention relates to a construction in which the core material is pressed against the bottom body from its upper face by means of a pressure projection formed on the bottom body. Important features of this invention are to provide a footwear in which core material can be fixed on the bottom body simply, easily and surely, there being no necessity to insert the core material into the bottom body, and also to provide footwear which is most suitable for mass production.

Footwear according to the present invention comprises a bottom body formed from soft synthetic resin and a hard or semihard core material laid on the bottom body, said bottom body having a pressure projection protruding upward from its upper face, the peripheral edge of said pressure projection having a fitting construction for the core material where the core material is locked to the bottom body. The footwear thus constructed can be adaptable to shoes, sandals, slippers, etc.

The bottom body of the footwear of this invention is formed from soft synthetic resin, particularly soft synthetic resin foamed body, and preferably formed with a pressure projection on its upper face. A most important pressure projection is the one formed at the Yusen part 3 shown in FIG. 1, and the core material is locked to the bottom body by means of said pressure projection. This pressure projection may be formed as one larger pressure projection covering vital points 3, 4 and 5 shown in FIG. 1. Also, it is possible to provide other pressure projections at positions 1 and 2 as well as at the center portion between the parts 7 and 7, etc,. optionally. The pressure projection body usually has a gentle mountain-like shape, but it may be of a somewhat steeper mountain-like shape or a greatly gentle mountain-like shape depending on position where the pressure projections are provided. All that is necessary is to provide desired pressing conditions within the footwear.

The fitting construction for the core material is provided at least in the pressure projection at the Yusen part. The fitting construction is such one that a peripheral groove is formed along the bottom face, the breadth of said groove corresponding to the thickness of the core material so that the core material can be fitted in said peripheral groove, thereby being locked to the bottom face. In order to prevent lateral deviation of the core material, it is a matter of course that protruding ends may be formed at the lower portion and both side portions of the bottom body or the bottom body may be formed with holes for inserting projecting members for preventing the lateral deviation of the core material. The pressure projection may also be provided with a projection core at the upper portion thereof. The projection core is made of a hard material, and it is generally selected from hard synthetic resin, semihard synthetic resin, metal, magnet and so on. The projection core is generally formed in the shape of an obtuse angled cone so as to stimulate the surface of skin moderately. This projection core is inserted in a hole formed in the pressure projection fixedly or removably.

On the other hand, the core material is molded from hard or semihard synthetic material, and this core material is adapted to give a hardness to the bottom body so as to avoid the bending at the intermediate portion thereof. Accordingly, if it is provided approximately on the rear half portion of the bottom body as shown in FIG. 4, it may perform its duty. However, it is a matter of course that the core material is laid on all the surface of the bottom body as shown in FIG. 6. Since the core material is to be locked by means of the pressure projection of the bottom body, a locking portion is formed in the core material in semicircular manner or whole circular manner, and said locking portion is fitted in the fitting construction of the pressure projection to lock the core material to the bottom body. Also, the core material may be formed with holes at positions corresponding to pressure projection portions protruding from the bottom body and other pressure projections may be passed through said holes, respectively, as shown in FIGS. 6 and 7, besides said locking portion. It is also preferable that the bottom body be made of soft synthetic resin and the core material may be mixed with iron oxide and then subjected to magnetization, thereby converting the whole into a magnet so as to allow them to serve for the health. The hard or semihard core material may also be mixed with a metal such as uranium oxide, thorium oxide, niobium oxide, tantalum oxide, yttrium oxide, cesium oxide, iron oxide and so on. The bottom body and the core material thus constructed are formed and worked separately, and thereafter locked together appropriately by means of the fitting portions thereby making footwear.

PREFERRED EMBODIMENTS

Figure 1:
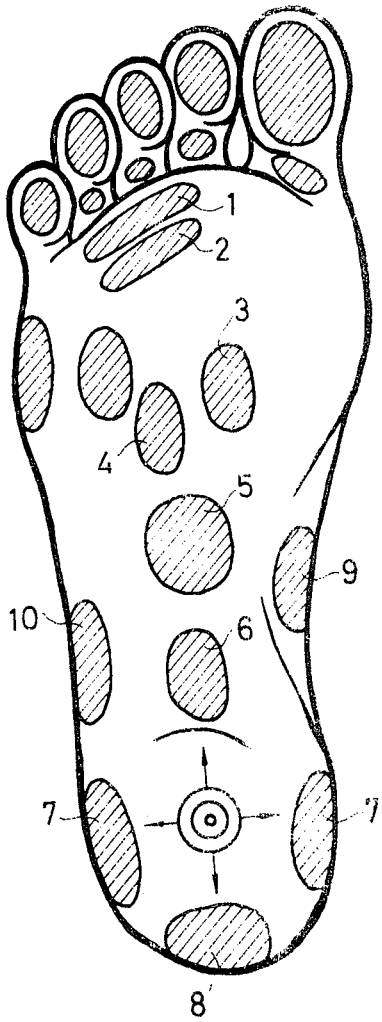
FIG. 1 is the Ingamu-si-observation figure which shows main vital points on the sole.
Figure 2:
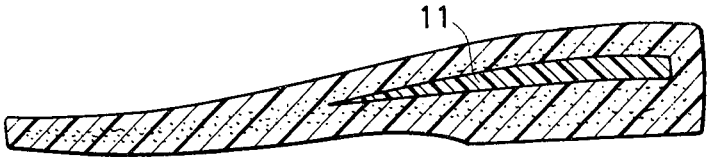
FIG. 2 is a longitudinal sectional side view of the bottom of a prior art sandal integrally molded.
Figure 3:
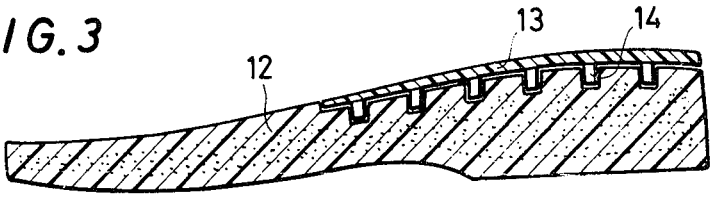
FIG. 3 is a longitudinal sectional side view of the bottom of a sandal representing a prior attempt at solving the problems addressed by the present invention, in which the core material is separately molded and fixedly inserted in the upper portion of the bottom.
Figure 4:
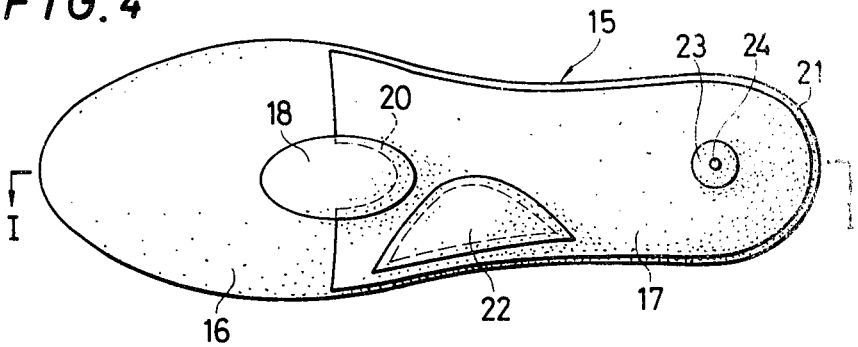
FIG. 4 is a plan view showing an embodiment of the sole of a footwear of the present invention.
Figure 5:
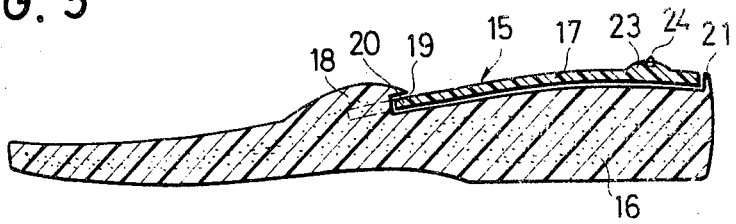
FIG. 5 is a longitudinal sectional side view taken on the line I—I of FIG. 4.

An embodiment of a footwear according to the present invention is shown in FIGS. 4 and 5. A bottom 15 comprises a bottom body 16 molded from soft synthetic resin and a core material 17 laid thereon, and said bottom body 16 has a pressure projection 18 protruding above the upper face of the core material 17. The peripheral edge of said pressure projection 18 is formed with a groove 19 in which the peripheral edge 20 of the core material is fitted so as to prevent the core material from pulling out therefrom upwards. 21 is a projecting end of the bottom body to prevent the lateral deviation of the core material. The core material 17 has pressure projections 22 and 23 formed thereon, and a projection core 24 is also already integrally molded.

The pressure projections are generally provided near the root part of the toes, near the arch of the foot part, near the Yusen part located slightly forward of the arch of the foot part and near the center, and at the heel part, and these pressure projections are integrally molded together with the bottom body at the time of the molding of the bottom body, and in general has softness and elasticity like the bottom body.

The core material is, in one embodiment, laid only on the rear portion of the upper face of the bottom body, but there is another embodiment where it is laid all over the upper face of the bottom body. However, in such an embodiment it is necessary to make thin the forward portion of the core material so as to allow the bending of the forward portion thereof while walking.

The construction in which the pressure projection secures the core material to the bottom body is roughly divided into two kinds. The first construction is one such as that shown in FIGS. 4 and 5, the peripheral edge of the core material being fitted in the groove of the pressure projection. The second construction is one such as that shown in FIGS. 6, 7 and 8, the core material being provided with a through-hole passing through both the upper and lower faces thereof and the pressure projection being passed through said hole and also the pressure projection being provided with a groove 5 all around the peripheral edge thereof and thus the peripheral edge of said through-hole of the core material is fitted into said groove.

Figure 6:
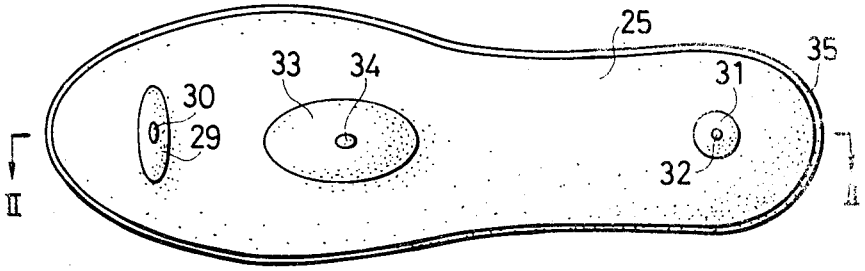
FIG. 6 is a plan view of the sole of a footwear of another embodiment of the present invention.
Figure 7:
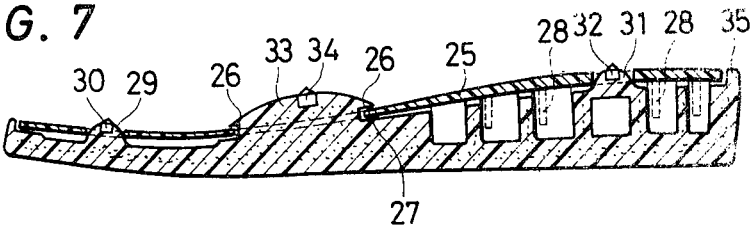
FIG. 7 is a longitudinal sectional side view taken on the line II—II of FIG. 6.

In FIGS. 6 and 7, the core material 25 is laid on the whole bottom body and has holes at positions corresponding to the pressure projections 29, 31 and 33, which are passed through said holes from the bottom body. 26 is a groove formed around the circular edge of the pressure projection 33, and the peripheral edge 27 of the through-hole of the core material 25 is fitted into said groove 26. 28, 28 are protruding portions which project on both sides and which are adapted to be inserted into holes formed in the bottom body to assist the core material in locking to the bottom body. 35 is a protruding end of the bottom body which is adapted to hold the rear end of the core material. 30, 32 and 34 are projection cores.

Figure 8:
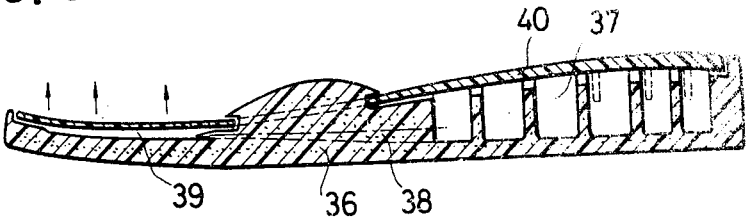
FIG. 8 is a longitudinal sectional side view of the sole of a footwear of a further embodiment of the present invention.

FIG. 8 shows another embodiment, in which a hollow pump chamber 37 is formed mainly at the heel portion of the bottom body 36 and said pump chamber 37 is led to the forward portion of the bottom body through a ventilation channel 38, so that when the core material 40 is trod by the foot, the pump chamber 37 is deformed thereby resulting in effecting the ventilation through said ventilation channel 38.

In the footwear of the present invention, as described above, a hard or semihard core material is laid on the soft bottom body which has a pressure projection protruding above the upper face of the core material, and said pressure projection has its peripheral edge formed so as to fit in the peripheral edge of the core material or the peripheral edge of a through-hole of the core material, so that the core material is locked by means of the soft pressure projection protruding upwards from the core material, and as a result, the core material can be easily and quickly fitted around the peripheral edge of the pressure projection, and since the core material is locked by being pressed down against the bottom body from above, the core material can be strongly fixed against slipping off the bottom body, and also in the production of the bottom body, it is unnecessary to insert the core material into the bottom body, so that the productivity of the production of the bottom body can greatly increase.

What is claimed is:

1. Footwear, comprising:

a bottom body composed of soft synthetic resin and having a pressure projection protruding upwardly from the upper surface thereof;

a relatively rigid core body composed of a hard or semihard material, said core body being positioned over at least the heel portion of said bottom body and having an edge portion which engages at least a portion of said pressure projection, said pressure projection protruding above the level of the upper surface of said core body; and interfitting means for engagement of said core body by said pressure projection to prevent said core body from pulling out upwardly from said bottom body.

2. Footwear in accordance with claim 1 wherein said interfitting means comprises a groove on a peripheral edge of said pressure projection, said edge portion of said core body which engages said pressure projection being interfittingly engaged with said groove.

3. Footwear as claimed in claim 1, wherein said core body is positioned only over the rear half of said bottom body, and wherein said pressure projection is located at about the central portion of said bottom body.

4. Footwear as claimed in claim 1, wherein said core body is positioned over substantially the whole surface of said bottom body, except for an aperture at the position of said pressure projection, said pressure projection being located at about the central portion of said bottom body.

5. Footwear as claimed in claim 1, wherein said bottom body has two or more pressure projections which protrude above said core body.

6. Footwear as claimed in claim 1, wherein said core body has at least one pressure projection, integral therewith, on the upper surface thereof.

7. Footwear as claimed in claim 1, wherein said pressure projection has a projection core buried in the upper portion thereof and protruding thereabove, said projection core being made of a material selected from the group consisting of hard synthetic resin, semihard synthetic resin, metal and magnet.

8. Footwear as claimed in claim 1, wherein said bottom body and/or said core body is mixed with powder magnet thereby allowing the footwear as a whole to have magnetism.

* * * * *